US008919176B2

(12) United States Patent
Barezzani et al.

(10) Patent No.: US 8,919,176 B2
(45) Date of Patent: Dec. 30, 2014

(54) HYDRODYNAMIC TOOL, A HYDRAULIC PUMP AND A MECHANISM FOR TRANSFORMING A ROTARY MOTION INTO AN OSCILLATING TRANSLATION MOTION FOR SUCH A TOOL

(75) Inventors: Gualtiero Barezzani, Concesio (IT); Cesare Braga, Brescia (IT)

(73) Assignee: Cembre S.p.A., Brescia (IT)

( * ) Notice: Subject to any disclaimer, the term of this patent is extended or adjusted under 35 U.S.C. 154(b) by 0 days.

(21) Appl. No.: 14/117,204

(22) PCT Filed: Jun. 1, 2011

(86) PCT No.: PCT/IT2011/000184

§ 371 (c)(1),
(2), (4) Date: Nov. 12, 2013

(87) PCT Pub. No.: WO2012/164590

PCT Pub. Date: Dec. 6, 2012

(65) Prior Publication Data

US 2014/0182874 A1 Jul. 3, 2014

(51) Int. Cl.

| | |
|---|---|
| ***B21J 9/18*** | (2006.01) |
| ***B25F 5/00*** | (2006.01) |
| ***B25B 27/10*** | (2006.01) |
| *F15B 15/18* | (2006.01) |

(52) U.S. Cl.

CPC ..... *B25F 5/005* (2013.01); *B25B 27/10* (2013.01); *F15B 15/18* (2013.01)

USPC ..... 72/453.05; 72/453.15

(58) Field of Classification Search

USPC ..... 72/416, 453.01, 453.02, 453.03, 72/453.06, 453.07, 453.15, 453.16; 417/416, 417; 74/25; 29/751; 100/270, 100/271

See application file for complete search history.

(56) References Cited

U.S. PATENT DOCUMENTS

| | | | | |
|---|---|---|---|---|
| 1,978,866 | A * | 10/1934 | Konig | 417/417 |
| 2,986,761 | A * | 6/1961 | Deibel et al. | 15/250.02 |
| 4,832,578 | A * | 5/1989 | Putt | 417/266 |
| 5,111,681 | A * | 5/1992 | Yasui et al. | 72/453.03 |
| 6,446,482 | B1 | 9/2002 | Heskey et al. | |
| 7,086,979 | B2 * | 8/2006 | Frenken | 475/182 |
| 7,412,868 | B2 * | 8/2008 | Frenken | 72/453.15 |
| 8,276,430 | B2 * | 10/2012 | Barezzani et al. | 72/453.15 |
| 2005/0132771 | A1 | 6/2005 | Lefavour et al. | |

FOREIGN PATENT DOCUMENTS

WO WO 2008/032341 A1 3/2008

* cited by examiner

*Primary Examiner* — Edward Tolan

(74) *Attorney, Agent, or Firm* — Dickstein Shapiro LLP

(57) ABSTRACT

A hydrodynamic compression and/or cutting tool (1) comprises an electric motor (6), a transformation mechanism (8) suitable for transforming the rotary motion of the motor (6) into an oscillating translation motion, a two-speed hydraulic pump (11) suitable for carrying out an increase in pressure of a pressure fluid acting on an actuation piston (12) in response to the oscillating translation movement so as to move the actuation piston (12).

17 Claims, 5 Drawing Sheets

HYDRODYNAMIC TOOL, A HYDRAULIC PUMP AND A MECHANISM FOR TRANSFORMING A ROTARY MOTION INTO AN OSCILLATING TRANSLATION MOTION FOR SUCH A TOOL

The object of the present invention is a hydrodynamic tool in particular for carrying out operations of compression, cutting, spreading apart or traction, etc. Also forming objects of the present invention are a hydraulic pump and a mechanism for transforming a rotary motion into an oscillating translation motion for such a hydrodynamic tool.

In order to carry out certain connection operations, for example the compression of connectors around electrical cables, the compression of rivets, or cutting operations, for example the cutting of electrical cables during the installation and maintenance of electrical systems, hydrodynamic compression and/or cutting tools are often used that are actuated by a motor.

Such tools usually comprise an electric motor fed by a battery and equipped with a drive shaft connected to a transformation mechanism that transforms the rotary motion of the drive shaft into an oscillating translation motion that causes, in a hydrodynamic group connected to it, an increase in pressure of a hydraulic liquid acting on a piston to move the latter against the force of a return spring. The piston is in turn connected with a mobile jaw so as to move it, during the compression operation, towards a fixed jaw of the tool. The jaws can be configured and/or equipped with accessory elements so that the coming together of the jaws allows the desired compression or cutting to be carried out.

The hydrodynamic tools of the type specified above must meet some specific requirements of the fields in which they are most commonly used, which are difficult to reconcile and that, as will be illustrated hereafter, have not yet been satisfied by known tools currently available on the market.

Since compression tools are very often used outdoors, for example along railway lines remote from buildings equipped with a connection to the electrical power mains, they need their own electrical energy source, in other words a portable electrical battery integrated in or applied to the tool. Such a battery provides a limited amount of electrical energy that determines its autonomy, i.e. the number of operations that can be carried out through the tool without having to replace the battery. In order to maximise the number of operations that can be carried out it is therefore desirable to reduce as much as possible the energy used for every single operation, in other words for every single complete stroke of the mobile jaw. Regarding this, the present invention considers, both individually and in combination, the energy dissipated during the pumping of the hydrodynamic group and also the energy dissipated by means of the resistance and the friction of the motion transformation mechanism.

A further requirement of hydrodynamic tools derives from the fact that for example the compression operations, in particular those aimed at making connections between connectors and/or electrical cables, are hindered by very tight space conditions, for example in a box or in a cable line that joins a large amount of cables very close to one another. Therefore, it is essential for compression tools to have a small bulk and, in order to be able to gain easy access to the intervention areas, a preferably elongated shape with small lateral dimension.

A third requirement is that of being able to carry out the compression and cutting operations with appropriate speed in order to reduce the time, costs and physical effort expended by the user.

Hydrodynamic pumping groups are known with two different flow rates that switch as a function of the pressure of the hydraulic fluid from a high pumping flow rate to a low pumping flow rate. Such known hydrodynamic groups allow a piston to be made to advance quickly until a threshold pressure is reached in the hydraulic fluid and, once the threshold pressure has been exceeded, they allow the piston to be made to advance more slowly but at a higher pressure, in order to carry out, for example, a pressing or cutting operation. The use of known two-speed hydrodynamic groups would allow the mutual movement of the jaws of a hydrodynamic tool to be sped up until the engagement of the piece to be manipulated and, during the manipulation itself, they would allow there to be a suitably large hydrodynamic force.

However, since known two-speed hydrodynamic groups are complex and bulky and they require a large number of ducts, valves and/or cylinder-piston groups, they are difficult to reconcile with the requirements of the hydrodynamic tools discussed above.

Transformation mechanisms for transforming the rotary motion of a drive shaft into an oscillating translation motion are also known. One type of known transformation mechanism comprises a thrusting group with a rotary plate, a plate that is able to translate but is blocked against rotation and rolling members arranged in contact between the two interfacing plates, wherein at least one of the plates forms a cam-shaped rolling track to transform a rotation of the rotary plate into an oscillating translation movement of the plate that is able to translate. In a rising step of the rolling members towards a vertex of the rolling cam track, the rolling members tend to oppose the rising and, once a certain limit has been exceeded, they tend to slide with sliding friction along the rolling track. The occurrence of sliding friction involves the wearing of the components and undesirable energy losses.

A further known transformation mechanism comprises a thrusting group with a plate rotating around a central axis and that forms a rolling cam track, a translatable body along the central axis but blocked against rotation around the central axis and two rollers fixedly connected to the translatable body and in rolling contact with the rolling track of the rotary plate. In this known solution the rollers roll just on a single rolling track and transmit the movement imposed by the cam track directly to the translatable body. The rollers held still by the translatable body cannot oppose rising.

However, in this known solution sliding friction occurs between the rollers and the translatable body or between the rollers and a roller axle that fixedly connects the rollers to the translatable body. Moreover, the circumference and therefore the length of the rolling track on a radially outer side of the roller is greater than the length of the rolling track on a radially inner side. This means further sliding friction that compensate for the fact that relative rotations between the outer side and the inner side of the roller itself are impossible. Also in this case, the occurrence of sliding friction involves the wearing of the components and undesirable energy losses.

A main purpose of the present invention is to provide a hydrodynamic tool that is small in size and that allows a fast work cycle.

A further purpose of the invention is to make a hydrodynamic tool having low energy consumption.

A further purpose of the invention is to make a hydrodynamic tool having a two-speed hydraulic pump that is simple, strong and not very bulky.

A further purpose of the invention is to make a hydrodynamic tool having a mechanism for transforming a rotary movement into an oscillating translation movement, wherein the sliding friction is low.

There and other purposes are accomplished through a hydrodynamic tool comprising:

an electric motor with a drive shaft, a transformation mechanism connected with the drive shaft and suitable for transforming a rotary motion of the drive shaft into an oscillating translation motion of a translatable body, a hydraulic pump connected to the transformation mechanism and suitable for carrying out an increase in pressure of a hydraulic liquid acting on an actuation piston in response to the oscillating translation movement so as to move the actuation piston, in which the hydraulic pump comprises:

an actuation cylinder that receives the actuation piston, a pumping cylinder having a suction opening in non-return communication with a tank of pressure fluid and a discharge opening in non-return communication with the actuation cylinder, a pumping piston received in the pumping cylinder and fixedly connected to the translatable body so as to translate together with it, an auxiliary piston received in the pumping cylinder and fixedly connected to the translatable body through the interposition of a switching spring with elastic preload, so that:

when (the resultant of) the pressure of the fluid acting on the auxiliary piston is less than the elastic preload of the switching spring, the auxiliary piston and the pumping piston translate together with the translatable body, making a first pumping flow rate with a first pressure, when (the resultant of) the pressure of the fluid acting on the auxiliary piston is greater than the elastic preload of the switching spring, the auxiliary piston does not translate together with the pumping piston, making a second pumping flow rate with a second pressure, in which the first pumping flow rate is greater than the second pumping flow rate and the second pressure is greater than the first pressure (for the same force transmitted by the translatable body).

Thanks to the provision of an auxiliary piston together with the pumping piston and to the elastic coupling with preload of the auxiliary piston to the translatable body, the actuation piston of the hydrodynamic tool is moved automatically with different speeds and pressures according to the working requirements. In a first advancing step of the actuation piston (quickly bringing the jaws up to the piece to be pressed or cut), the hydraulic pump works at high flow rate with low pressure and in a second advancing step of the actuation piston (pressing or cutting of the piece) the hydraulic pump works at low flow rate with high pressure.

This makes it possible speed up the work cycle of the tool and reduce the number of rotations of the drive shaft and the electrical energy consumption necessary for the first advancing step of the actuation piston. Moreover, the arrangement of both pistons in the same pumping cylinder makes it possible to foresee a single intake valve and a single delivery valve and it involves a simplification and a reduction in bulk of the hydraulic pump.

In order to better understand the invention and appreciate its advantages, some non-limiting example embodiments thereof will be described hereafter, with reference to the attached figures, in which.

Figure 1:
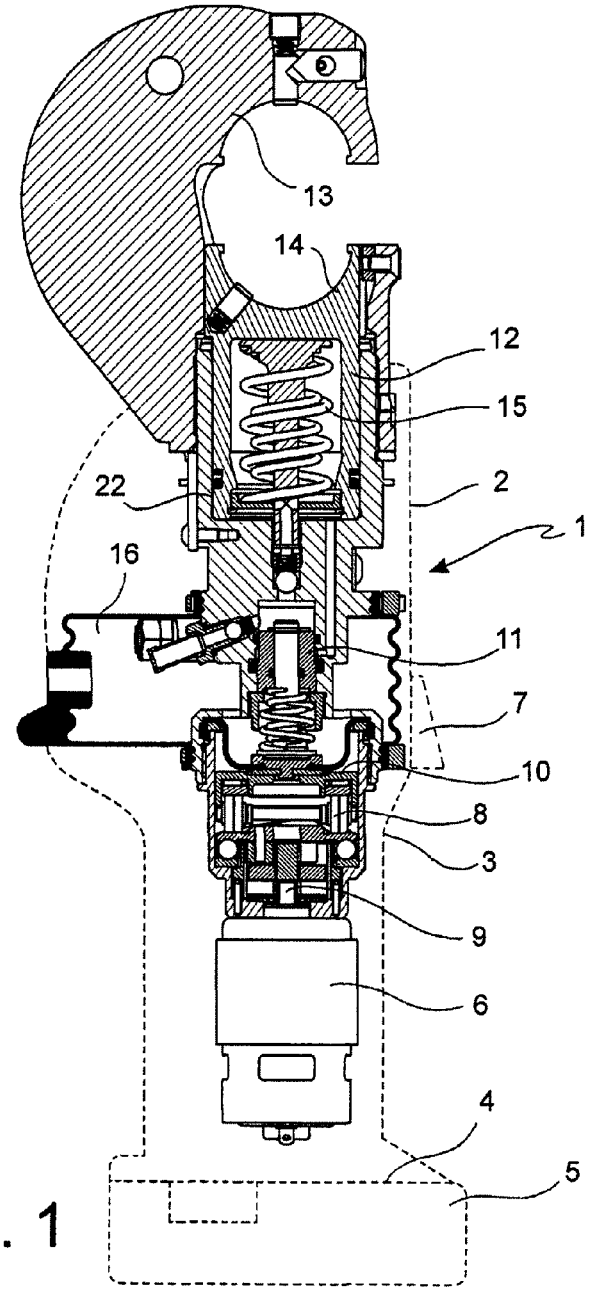
FIG. 1 is a longitudinal section view of a hydrodynamic compression and cutting tool according to an embodiment of the invention.
Figure 2:
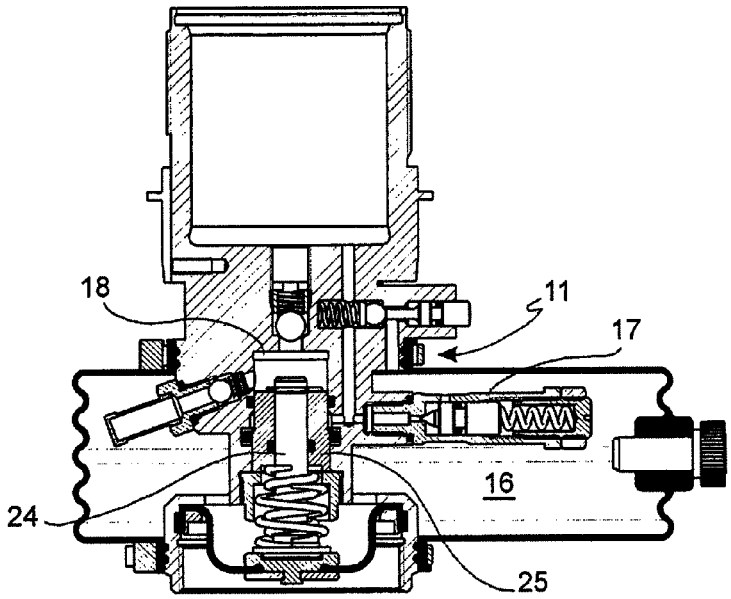
FIGS. 2 and 3 are longitudinal section views of a hydraulic pump of the tool in FIG. 1 in a first operating mode.
Figure 3:
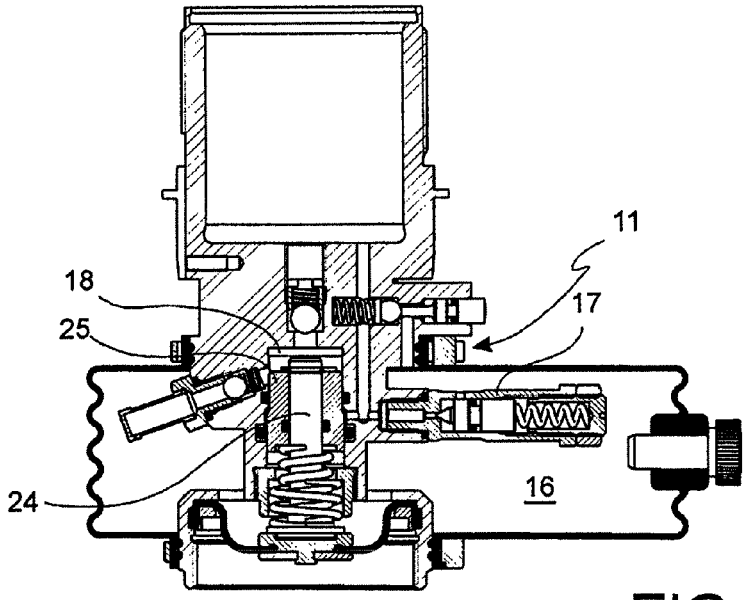
Figure 4:
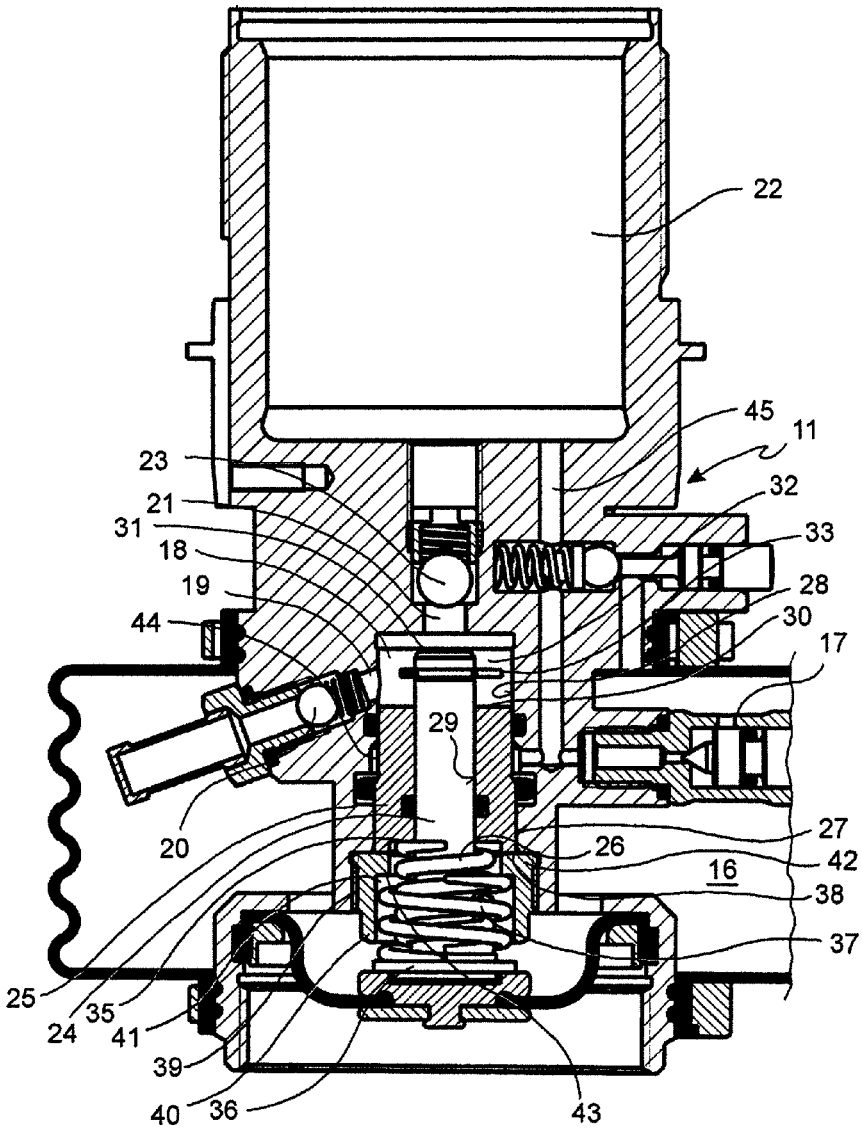
FIG. 4 is a partial longitudinal section view of the hydraulic pump of FIG. 2 in a second operating mode.

With reference to the figures, a portable hydrodynamic tool for carrying out operations of compression, cutting, spreading apart or traction etc. is wholly indicated with reference numeral 1.

The tool 1 comprises a housing 2 having an elongated shape with a central portion shaped like a grip 3 and a coupling portion 4 for the connection, preferably snap-connection, of an electrical battery 5 to the rear end of the tool 1. The housing 2 receives, preferably at the grip 3, an electric motor 6 able to be fed by the battery through a power supply circuit provided with a switch (not shown in detail) on which acts a manual actuation button 7 arranged adjacent to the grip 3.

A transformation mechanism 8 is arranged in the housing 2 on the side of the motor 6 opposite the battery 5. Such a transformation mechanism 8 is connected with a drive shaft 9 of the motor 6 and suitable for transforming the rotary motion of the drive shaft 9 into an oscillating translation motion of a translatable body 10. A hydraulic pump 11, also received in the housing 2, is connected to the transformation mechanism 8 and is suitable for carrying out an increase in pressure of a pressure fluid acting on an actuation piston 12 in response to the oscillating translation movement of the translatable body 10 so as to move the actuation piston 12 from a rest position into a work position.

The tool 1 also comprises a fixed jaw 13 rigidly connected to the housing 2 and arranged at a front end of the tool opposite the rear end, as well as a mobile jaw 14 supported in the housing so as to be able to slide with respect to the fixed jaw 13. The mobile jaw 14 is connected to the actuation piston 12 so that, in response to the movement of the actuation piston 12 into the work position, it is moved towards (or with respect to) the fixed jaw 13 to carry out an operation of compression or cutting (or, alternatively, traction or spreading apart). A main spring 15 acts between the fixed jaw and the actuation piston 12, so as to bias the latter together with the mobile jaw 14 elastically in the rest position.

According to an aspect of the invention, the hydraulic pump 11 comprises a tank 16, a cylinder—pumping piston group, a cylinder—actuation piston group and a maximum pressure valve 17.

The cylinder—actuation piston group comprises the aforementioned actuation piston 12 connected with the mobile jaw 14 and arranged in an actuation cylinder 22.

The cylinder—pumping piston group comprises a pumping cylinder 18 with an intake opening 19 connected with the tank 16 through a non-return valve 20 that allows the flow of the hydraulic oil from the tank 16 into the pumping cylinder 18, and a discharge opening 21 connected with the actuation cylinder 22 through a non-return valve 23 that allows the flow of the hydraulic oil from the pumping cylinder 18 into the actuation cylinder 22. The pumping cylinder 18 receives a pumping piston 24 fixedly connected to the translatable body 10 so as to translate together with it.

The same pumping cylinder 18 also receives an auxiliary piston 25 fixedly connected to the translatable body 10 through the interposition of a switching spring 26 with elastic preload, so that:

when (the resultant of) the fluid pressure acting on the auxiliary piston 25 is less than the elastic preload of the switching spring 26, the auxiliary piston 25 and the pumping piston 24 translate together with the translatable body 10 (first operating mode) and make a first pumping flow rate with a first pressure, when (the resultant of) the fluid pressure acting on the auxiliary piston 25 is greater than the elastic preload (and therefore overcomes the force) of the switching spring, the auxiliary piston 25 does not translate together with the pumping piston 24 (second operating mode), making a second pumping flow rate with a second pressure.

The pumping piston 24 and the auxiliary piston 25 are sized and positioned so that the first pumping flow rate is greater than the second pumping flow rate and the second pressure is greater than the first pressure for the same force transmitted by the translatable body 10 (In each of the first and second operating modes, the force transmitted by the translatable body of course varies as a function of the pressure variation in the main cylinder).

Thanks to the provision of the auxiliary piston 25 together with the pumping piston 24 and to the elastic coupling with preload of the auxiliary piston 25 to the translatable body 10, the actuation piston 12 of the hydrodynamic tool 1 is moved automatically with different speeds and pressures according to the work requirements. In a first advancing step of the actuation piston (quickly bringing the jaws up to the piece to be pressed or cut), the hydraulic pump 11 works at high flow rate with low pressure and in a second advancing step of the actuation piston (pressing or cutting of the piece) the hydraulic pump 11 works at low flow rate with high pressure.

This speeds up the work cycle of the tool and reduces the number of rotations of the drive shaft and the electrical energy consumption necessary for the first advancing step of the actuation piston. Moreover, the arrangement of both pistons 24, 25 in the same pumping cylinder makes it possible to foresee a single intake valve 20 and a single delivery valve 23 and it involves a simplification and a reduction in bulk of the hydraulic pump.

In accordance with an embodiment, the pumping piston 24 and the auxiliary piston 25 are coaxial and inserted one inside the other. Preferably, the cylinder-pumping piston group and the cylinder-actuation piston group are coaxial.

In particular, the auxiliary piston 25 can comprise a tubular body that forms a radially outer side surface 27 in sliding contact with an inner surface 28 of the pumping cylinder 18, an inner hole 29 that slidably receives the pumping piston 24 and an auxiliary front surface 30 that, together with a front pumping surface 31 of the pumping piston 24 and the inner surface 28 of the pumping cylinder 18, defines a pumping space 32 into which the intake and delivery openings 19, 21 open out.

The coaxial pistons inserted one inside the other bring a reduction in lateral bulk of the hydraulic pump and a simplification of its structure, as well as a reduction in the precision mechanical machining of the pumping cylinder (which is in direct contact with just one of the two pistons).

In accordance with an embodiment, the switching spring 26 elastically biases the auxiliary piston 25 (in an advancing or closing direction that corresponds to a reduction in the pumping space 32) against an abutment 33 of the pumping piston 24 that defines a reciprocal position of the pumping and auxiliary pistons 24, 25 during their movement as a unit. The abutment 33 can be formed close to a front end 34 of the pumping piston and can directly engage the front auxiliary surface 30 of the auxiliary piston 25.

As a non-limiting example, the abutment 33 can be formed from a plate or from a ring blocked in an annular groove formed in a radially outer side surface of the pumping piston 24.

In accordance with an embodiment, the switching spring 26 is precompressed and acts directly between the pumping piston 24 and the auxiliary piston 25, so that only the pumping piston 24 is directly engaged by the translatable body 10, whereas the auxiliary piston 25 is fixedly connected to the translatable body 10 only indirectly through the interposition of the pumping piston 24 and of the switching spring 26.

This makes it possible to make the hydraulic pump 11 as an autonomous group or module with a single point of contact or coupling with the transformation mechanism 8.

In accordance with an embodiment, the auxiliary piston 25, on a rear side thereof opposite the front side and the pumping space 32, forms an annular seat 35 that receives a front end of the switching spring 26. The pumping piston 24, on a rear side thereof opposite the front side and the pumping space, has a radially projecting shoulder 36 against which a rear end of the switching spring 26 abuts. The switching spring 26 can advantageously be a coil spring inserted over the pumping piston 24 that ensures its correct positioning.

The pumping piston 24 can be fixedly connected to the translatable body 10 through a simple pressing contact and a return spring 37 that elastically biases the pumping piston 24 into an open position corresponding to a withdrawn position of the translatable body 10.

On the rear side of the pumping cylinder 24, opposite the pumping space 32, an annular stop surface 38 is formed that limits the opening stroke of the auxiliary piston 25 and makes a rear end stop thereof. In this way, when the pressure of the hydraulic fluid overcomes the force of the switching spring 26 the auxiliary piston 25 pulls back to the point at which its rear edge abuts against the stop surface 38 and stays in such a position until the pressure of the hydraulic fluid falls below the threshold value determined by the preload of the switching spring 26.

In accordance with an embodiment, a closing sleeve 40 is screwed into a rear opening 39 of the pumping cylinder 24, forming a longitudinal through hole 41 through which extends a rear portion of the pumping piston 24, a front wall 42 that forms the stop surface 38 for the auxiliary piston 25 and an annular seat 43 (preferably formed from a rear surface of the front wall 42) that receives a front end of the return spring 37. The return spring 37 itself can be a coil spring slotted onto the pumping piston 24 and a rear end of the return spring can abut against the shoulder 36 of the pumping piston 24.

Making the closing sleeve 40 as a piece initially separate from the pumping cylinder 18 facilitates the mechanical machining and the assembly of the hydraulic pump 11.

Advantageously, the inner surface 28 of the pumping cylinder 18 and a portion of the side surface 27 of the auxiliary piston 25 define a stabilization chamber 44 in fluid communication with the actuation cylinder 22, but isolated from the pumping space 32 and from the pumping piston 24, in which the portion of the side surface 27 is shaped so that the fluid pressure inside the stabilization chamber 44 pushes the auxiliary piston 25 against the elastic force exerted by the switching spring 26.

In this way, at high fluid pressure and in particular in the pulling back step of the pumping piston 24 (intake step) the auxiliary piston 25 is held stably in the withdrawn position, thus avoiding situations of stalling in which a withdrawal of the pumping piston 24 would be involuntarily "compensated" by a simultaneous advancing of the auxiliary piston 25.

In accordance with an embodiment, the stabilization chamber 44 is an annular chamber extending all around the circumference of the pumping cylinder 18 and the portion of the side surface 27 of the auxiliary piston 25 that defines the stabilization chamber 44 forms a circumferential step with a thrusting surface facing towards the front side of the auxiliary piston 25.

The stabilization chamber 44 can be in communication with a return duct 45 of the fluid that connects the actuation cylinder 22 with the tank 16, and inside which the maximum pressure valve 17 is arranged, on the tank side.

There can be circumferential gaskets 60 between the pumping cylinder 18 and the auxiliary piston 25 on both sides (front and rear) of the stabilization chamber 44, as well as between the auxiliary piston 25 and the pumping piston 24.

Figure 5:
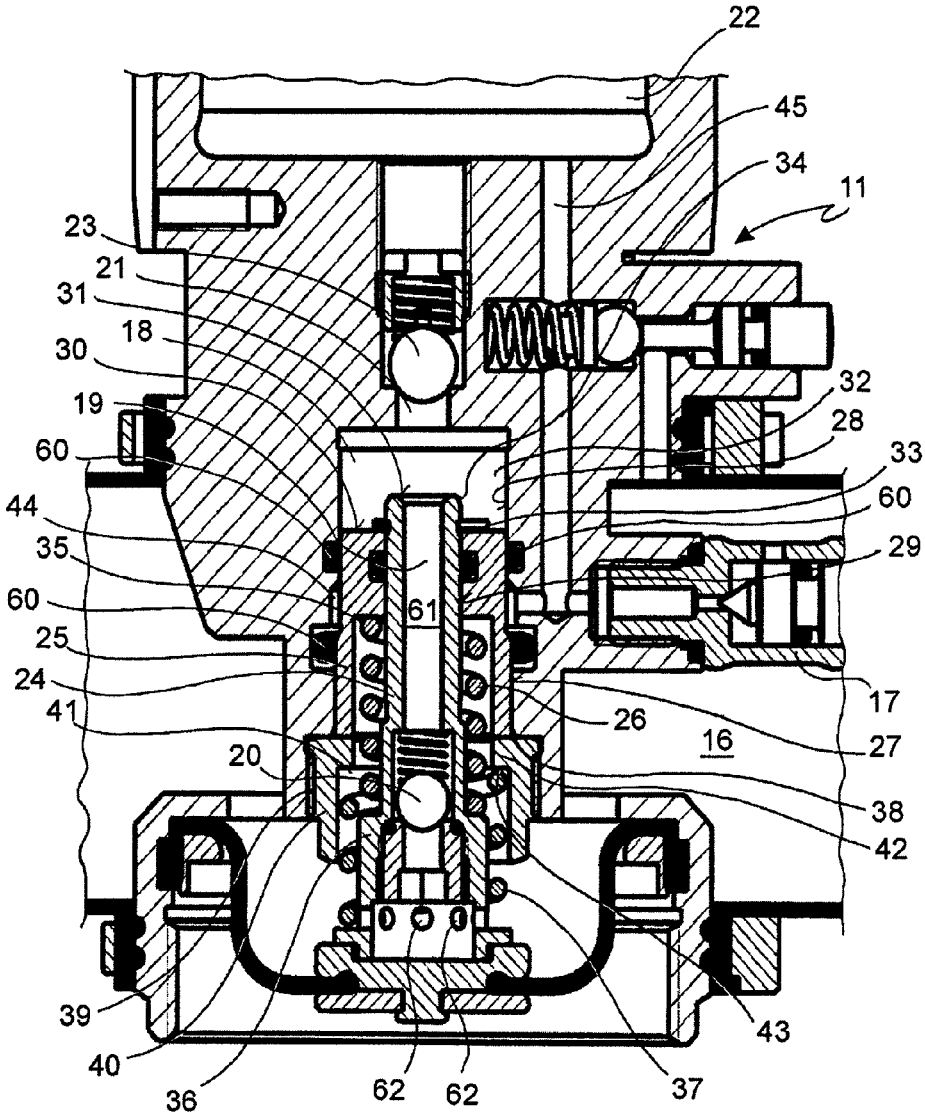
FIG. 5 is a partial longitudinal section view of a hydraulic pump for a hydrodynamic tool according to a further embodiment.
Figure 6:
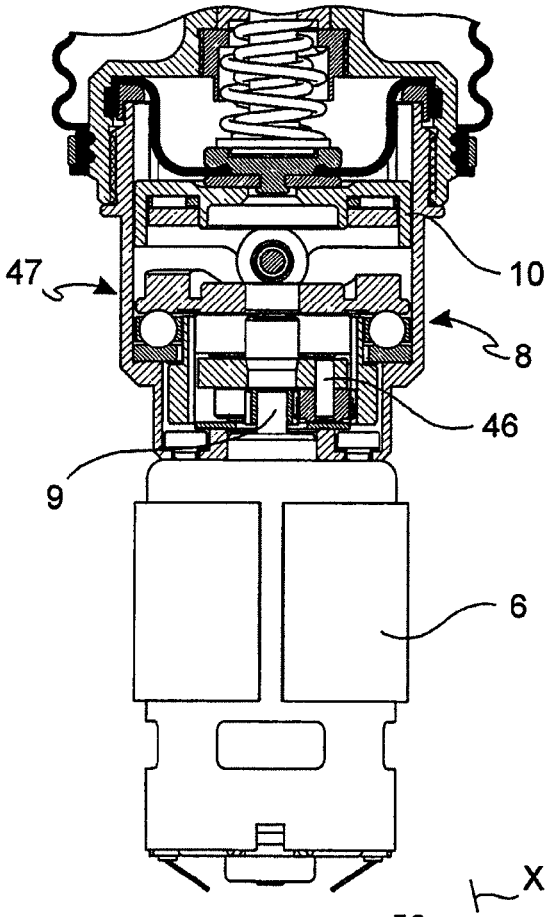
FIGS. 6 and 7 are longitudinal section views of a motion transformation mechanism of the tool according to an embodiment.
Figure 7:
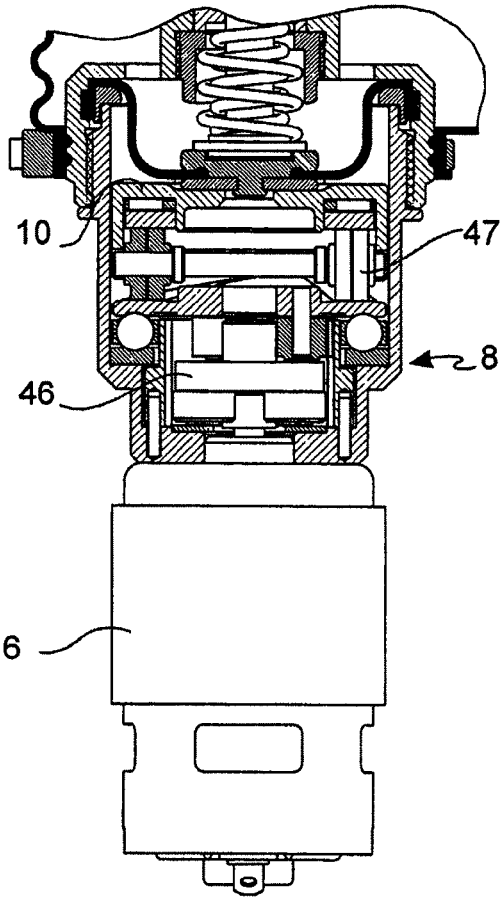
Figure 8:
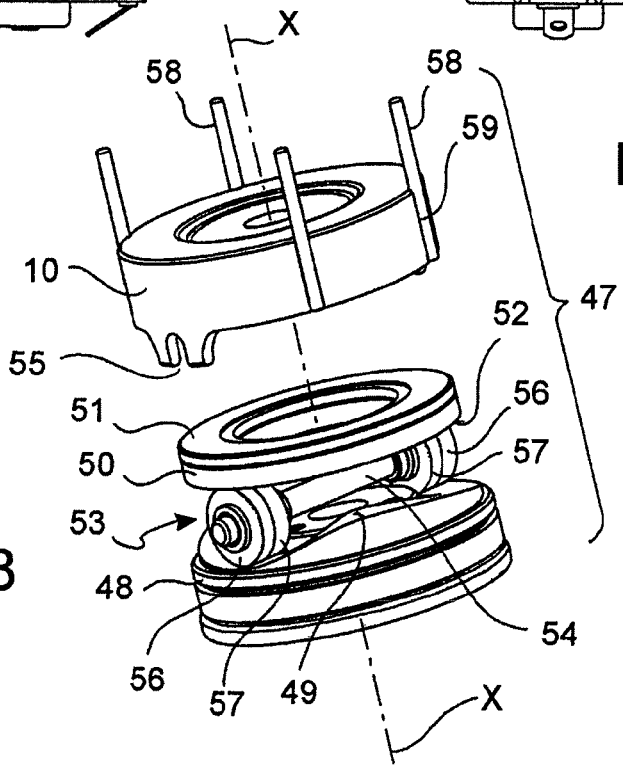
FIG. 8 is an exploded view of a detail of the transformation mechanism in FIG. 6.

In accordance with an embodiment (FIG. 5) the intake opening 19 of the pumping cylinder 18 is formed from the pumping piston 24 that has an inner channel 61 that receives the non-return valve 20 and opens out both into the front surface 31 and into the tank 16 through one or more holes 62 in a rear end of the pumping piston 24 that projects at the rear outside of the pumping cylinder 18.

By relocating the intake duct and the non-return valve from the side wall of the pumping cylinder inside the pumping piston, the bulk of the hydraulic pump is further reduced.

Hereafter the operation of the hydraulic pump of the hydrodynamic tool will be summarised. The oscillating translation movement of the translatable body causes an oscillating translation movement of the pumping piston and of the auxiliary piston fixedly connected to it thanks to the switching spring. The movement as a unit of both of the pistons pumps the pressure liquid with a high flow rate and low pressure from the tank into the actuation cylinder to make the actuation piston and, together with it, the mobile jaw quickly advance from the rest position into an engagement position with the piece to be worked. When the resistance of the piece to be worked raises the pressure of the hydraulic fluid beyond the threshold value determined by the elastic preload of the switching spring, the auxiliary piston is "decoupled" from the pumping piston and held in the withdrawn position, whereas the pumping piston continues to oscillate by itself, moving a smaller amount of fluid, but generating a greater fluid pressure for the same force transmitted by the translatable body. The work cycle of the pump thus continues with a low flow rate and a high fluid pressure until a predetermined maximum pressure is reached in the actuation cylinder.

According to a further aspect of the invention, the transformation mechanism 8 comprises a reduction group, for example a planet gear 46 connected to the drive shaft 9 and configured to reduce the speed of its rotary motion, as well as a thrusting group 47, functionally separate from the planet gear 46.

The thrusting group 47 comprises:

- a first plate 48 able to rotate around a central axis X and that forms a rolling cam track 49, the rotary plate 48 being connected to the reduction group,
- a second plate 50 equipped with a fifth wheel coupling 51 and forming a second rolling track 52 facing the rolling cam track 49,
- the translatable body 10 constrained so as not to be able to rotate around the central axis X but to be able to slide along the central axis X and coupled with the second plate 50 through the fifth wheel coupling 51 so that the translatable body 10 translates together with the second plate 50 along the central axis X and the second plate 50 can rotate with respect to the translatable body 10 around the central axis X,
- as well as rolling members 53 arranged between the rotary first plate 48 and the second plate 50 in rolling contact with their rolling tracks 49, 52 and constrained to the translatable body 10 so as not to rotate (or, in other words not to "orbit") around the central axis X.

The rolling members 53 transmit the forces and the axial movements from the rolling cam track 49 to the second plate 50 through rolling contact and the second plate 50 transmits the forces and the axial movements to the translatable body 10 through the fifth wheel coupling 51 (in other words through rolling contact), thus eliminating the sliding friction between the rolling members and the translatable body or an axle that constrains the rolling members to the translatable body 10.

In accordance with an embodiment, the rolling members 53 comprise rollers rotatably connected to an axle 54 that arranges them for example in diametrically opposite positions with respect to the central axis X and that has portions received in respective seats 55 of the translatable body 10, for example slots or grooves extending in the axial direction so as to constrain the position of the rollers in the circumferential direction with respect to the central axis X, but at the same time to allow their axial movement that is essential to ensure that the axial forces are transmitted by the rollers to the second plate 50 and not directly to the seats 55 of the translatable body 10.

In accordance with a further embodiment, the rolling members 53 comprise at least one or more rolling groups having a radially outer first roller 56 and a radially inner second roller 57 adjacent to the first roller 56, both the outer and inner rollers 56, 57 being arranged on the same side with respect to the central axis X and able to rotate with respect to one another so as to make a differential rolling contact with the rolling tracks 49, 52 and to reduce the sliding friction for the same overall radial extension of the rolling groups.

Advantageously, all of the rollers 56, 57 of the same rolling group can be fixed to the same axle 54 or hub.

The translatable body 10 can be slidably supported in the housing 2 in a guided manner along a plurality of (for example four) parallel guides axes arranged on a circumference around the central axis X. The guide axes are preferably made through four parallel plate-guiding columns 58 that engage four corresponding grooves 59 formed in a circumferential outer surface of the translatable body 10.

The thrusting group 47 can be coaxial to the planet gear 46 and the rotary plate 48 can be connected through pins to a train of satellites of the planet gear so as to rotate in response to the revolving movement of the train of satellites.

Thanks to the functional separation and the coaxial nature of the motion reduction group and of the thrusting group, the lateral bulk of the tool is reduced and lateral or asymmetric stresses in the motion transformation mechanism are avoided.

Moreover, for the same reasons, the thrusting group 47 and the planet gear 46 are preferably also coaxial with the pumping cylinder 18 and with the actuation cylinder 22.

Of course, a man skilled in the art can bring further modifications and variants to the hydrodynamic tool, to the hydraulic pump and to the motion transformation mechanism according to the present invention, in order to satisfy contingent and specific requirements, all of which are in any case covered by the scope of protection of the invention, as defined by the following claims.

The invention claimed is:

1. A hydrodynamic tool for compression and/or cutting comprising:

an electric motor with a drive shaft, a transformation mechanism connected with the drive shaft and suitable for transforming a rotary motion of the drive shaft into an oscillating translation motion of a translatable body, a hydraulic pump connected to the transformation mechanism and suitable for carrying out a pressure increase of a hydraulic liquid acting on an actuation piston in an actuation cylinder, in response to the oscillating translation movement, wherein the hydraulic pump comprises:

a pumping cylinder having an intake opening in non-return communication with a tank of pressure fluid and a delivery opening in non-return communication with the actuation cylinder, a pumping piston received in the pumping cylinder and fixedly connected to the translatable body so as to translate together with it, an auxiliary piston received in the pumping cylinder and fixedly connected to the translatable body through the interposition of a switching spring with elastic preload, so that:

when the pressure of fluid acting on the auxiliary piston is smaller than the elastic preload of the switching spring, the auxiliary piston and the pumping piston translate together with the translatable body, making a first pumping flow rate with a first pressure, when the pressure of fluid acting on the auxiliary piston is greater than the elastic preload of the switching spring, the auxiliary piston does not translate together with the pumping piston, making a second pumping flow rate with a second pressure, wherein the first pumping flow rate is greater than the second pumping flow rate and the second pressure is greater than the first pressure.

2. Hydrodynamic tool according to claim 1, wherein the pumping piston and the auxiliary piston are coaxial and inserted into one another.

3. Hydrodynamic tool according to claim 2, wherein the auxiliary piston comprises a tubular body forming:

a side surface in sliding contact with an inner surface of the pumping cylinder, an inner hole that slidably receives the pumping piston and, an auxiliary front surface that defines, together with a front pumping surface of the pumping piston and the inner surface of the pumping cylinder, a pumping space into which the intake and delivery openings open out.

4. Hydrodynamic tool according to claim 1, wherein the switching spring elastically biases the auxiliary piston against an abutment of the pumping piston that defines a mutual position of the pumping and auxiliary pistons during their movement as a unit.

5. Hydrodynamic tool according to claim 1, wherein the switching spring is precompressed and acts directly between the pumping piston and the auxiliary piston, and wherein just the pumping piston is directly engaged by the translatable body, whereas the auxiliary piston is fixedly connected to the translatable body only indirectly through the interposition of the pumping piston and of the switching spring.

6. Hydrodynamic tool according to claim 1, wherein the switching spring comprises a coil spring inserted over the pumping piston and having a front end received in an annular seat of the auxiliary piston and a rear end abutting against a radially projecting shoulder of the pumping piston.

7. Hydrodynamic tool according to claim 1, wherein at the pumping cylinder a stop surface is formed that makes a rear end stop thereof for the opening stroke of the auxiliary piston.

8. Hydrodynamic tool according to claim 7, wherein a closing sleeve is screwed into a rear opening of the pumping cylinder, said closing sleeve forming:

a longitudinal hole through which a rear portion of the pumping piston extends, a front wall that forms the stop surface for the auxiliary piston and an annular seat that receives a front end of a return spring that elastically biases the pumping piston into an open position.

9. Hydrodynamic tool according to claim 1, wherein an inner surface of the pumping cylinder and a side surface portion of the auxiliary piston define a stabilization chamber isolated from the pumping piston and in fluid communication with the actuation cylinder, wherein the side surface portion is shaped so that the fluid pressure inside the stabilization chamber pushes the auxiliary piston against the elastic force of the switching spring.

10. Hydrodynamic tool according to claim 9, wherein the stabilization chamber is an annular chamber extending all around the circumference of the pumping cylinder and the side surface portion of the auxiliary piston that defines the stabilization chamber forms a circumferential step with a thrusting surface facing towards a front side of the auxiliary piston.

11. Hydrodynamic tool according to claim 9, wherein the stabilization chamber is in fluid communication with a return duct connected to the actuation cylinder and, through a maximum pressure valve, to the tank.

12. Hydrodynamic tool according to claim 1, wherein the pumping piston forms an inner channel that receives a non-return valve and that opens out into a front surface of the pumping piston and into the tank, forming said intake opening of the pumping cylinder.

13. Hydrodynamic tool according to claim 1, wherein the transformation mechanism comprises a thrusting group having:

a first plate rotatable by the motor around a central axis and that forms a rolling cam track, a second plate equipped with a fifth wheel coupling and forming a second rolling track facing the rolling cam track, the translatable body supported so as to be able to slide along the central axis and so as not to be able to rotate around the central axis, the second plate being coupled with the translatable body through the fifth wheel coupling so that the translatable body translates together with the second plate along the central axis and the second plate can rotate with respect to the translatable body around the central axis, rolling members arranged between the first rotary plate and the second plate in rolling contact with their rolling tracks and fixedly connected to the translatable body so as not to orbit around the central axis.

14. Hydrodynamic tool according to claim 13, wherein the rolling members comprise rollers in diametrically opposite positions with respect to the central axis and rotatably connected to an axle supported in respective seats of the translatable body that lock the position of the axle and of the rollers in a circumferential direction to the central axis (X) and allow an axial movement of the axle with respect to the seats.

15. Hydrodynamic tool according to claim 13, wherein the rolling members comprise at least one or more rolling groups having a first radially outer roller and a second radially inner roller adjacent to the first roller, both the outer and inner rollers being arranged on the same side with respect to the central axis and able to rotate with respect to one another so as to make a differential rolling contact with the rolling tracks.

16. Hydrodynamic tool according to claim 15, wherein all of the rollers of the same rolling group are fixed to the same axle or hub.

17. Hydrodynamic tool according to claim 13, wherein the thrusting group and a planet gear are coaxial with the pumping cylinder and with the actuation cylinder of the hydraulic pump.

* * * * *